United States Patent [19]

Bates

[11] Patent Number: 4,771,590

[45] Date of Patent: Sep. 20, 1988

[54] SADDLE CONSTRUCTION

[76] Inventor: Kenneth J. Bates, Lot 2, Glen Road, Darlington, Australia

[21] Appl. No.: 826,483

[22] PCT Filed: May 8, 1985

[86] PCT No.: PCT/AU85/00102

§ 371 Date: Jan. 3, 1986

§ 102(e) Date: Jan. 3, 1986

[87] PCT Pub. No.: WO85/05093

PCT Pub. Date: Nov. 21, 1985

[30] Foreign Application Priority Data

May 8, 1984 [AU] Australia ..... PG4882

[51] Int. Cl.[4] ..... B68C 1/02

[52] U.S. Cl. ..... 54/44

[58] Field of Search ..... 54/44, 65, 66

[56] References Cited

U.S. PATENT DOCUMENTS

| | | | |
|---|---|---|---|
| 3,112,592 | 12/1963 | Schindler | 54/44 |
| 3,286,440 | 11/1966 | Walker et al. | 54/44 |
| 3,698,608 | 10/1972 | Entwistle | 54/44 X |
| 4,287,705 | 9/1981 | Frost et al. | 54/44 |
| 4,502,266 | 3/1985 | Friedson . | |

FOREIGN PATENT DOCUMENTS

| | | | |
|---|---|---|---|
| 5419579 | 12/1978 | Australia . | |
| 2259376 | 6/1974 | Fed. Rep. of Germany . | |
| 19019 | 9/1914 | France . | |
| 2550521 | 2/1985 | France . | |
| 378365 | 8/1932 | United Kingdom | 54/66 |
| 1233344 | 5/1971 | United Kingdom . | |

*Primary Examiner*—Robert P. Swiatek

*Attorney, Agent, or Firm*—Harness, Dickey & Pierce

[57] ABSTRACT

A method of making a saddle wherein the upper saddle coverings including the seat, backs and upper flaps are pressed from a single sheet member, the underside saddle coverings including the panel, lining and underflaps also being pressed from a single sheet member, the upper and lower pressed saddle coverings being secured to a saddle tree placed between the coverings and the saddle completed by stitching the upper and lower pressed saddle coverings together around the periphery of the cantle and the periphery of the seat. The saddle coverings are formed from a composite sheet material composed of a cloth-covered foam.

9 Claims, 3 Drawing Sheets

SADDLE CONSTRUCTION

This invention relates to an improved saddle construction.

In the past saddle construction has been a very time consuming and costly operation with the experienced saddlor having to "build up" his saddle on a conventional saddle tree by the addition of webbing, shaped padding and other material. This enables a particular shape of saddle to be formed which then receives a covering of leather and other materials to provide the finished product. In the past the material to be added or "built on" to the saddle tree has been either rivetted, stapled or glued to the wooden saddle tree. More recently saddle trees have been constructed or formed from rigid plastics material with thin carbon rods being inserted in the thinner lighter racing saddles to give the desired strength to the saddle tree. With the introduction of this form of saddle tree, one particular problem has arisen in that material cannot be readily stapled to the tree in the saddle built-up process.

An improved method of constructing a saddle and overcoming the above mentioned difficulties is disclosed in our own Australian Pat. No. 524616 wherein the upper saddle coverings including the seat, backs and upper flaps are formed into a single upper member, the underside saddle coverings including the panel, lining and underflaps are formed into a single underside member, said upper and underside members being secured together around the periphery of the seat to form a pocket thereby enabling a saddle tree to be inserted, said upper and underside members being secured together and to the cantle of the saddle tree to form a saddle.

Whilst this method of construction is satisfactory, continual development work has produced a faster more efficient and more economical form of saddle construction. This invention covers further improvements to the method disclosed in our Australian Pat. No. 524616.

In one form the invention resides in a method of making a saddle wherein the upper saddle coverings including the seat, backs and upper flaps are pressed from a single sheet member, the underside saddle coverings including the panel, lining and underflaps also being pressed from a single sheet member, said upper and lower pressed saddle coverings being secured to a saddle tree placed between said coverings and the saddle completed by stitching the upper and lower pressed saddle coverings together around the periphery of the cantle and the periphery of the seat.

Preferably the pressed saddle coverings are glued to the saddle tree and the sheet member comprises cloth covered cross linked closed cell polyethylene foam.

In another form the invention resides in a method of making a saddle wherein the upper saddle coverings including the seat, backs and upper flaps are pressed from a single sheet member, the underside saddle coverings including the panel, lining and underflaps also being pressed from a single sheet member, said upper and lower pressed saddle coverings being secured together around the periphery of the cantle to form a pocket thereby enabling a saddle tree to be inserted, the saddle tree is inserted into said pocket and the saddle completed by securing the upper and underside coverings together around the periphery of the seat.

Preferably the upper and underside coverings are each pressed from cloth covered cross linked closed cell polyethylene foam in two separate parts. The two separate sections are then stitched together to form a single complete upper or underside covering.

The invention will be better understood by reference to the following description of one specific embodiment as shown in the accompanying drawings wherein.

Figure 1:
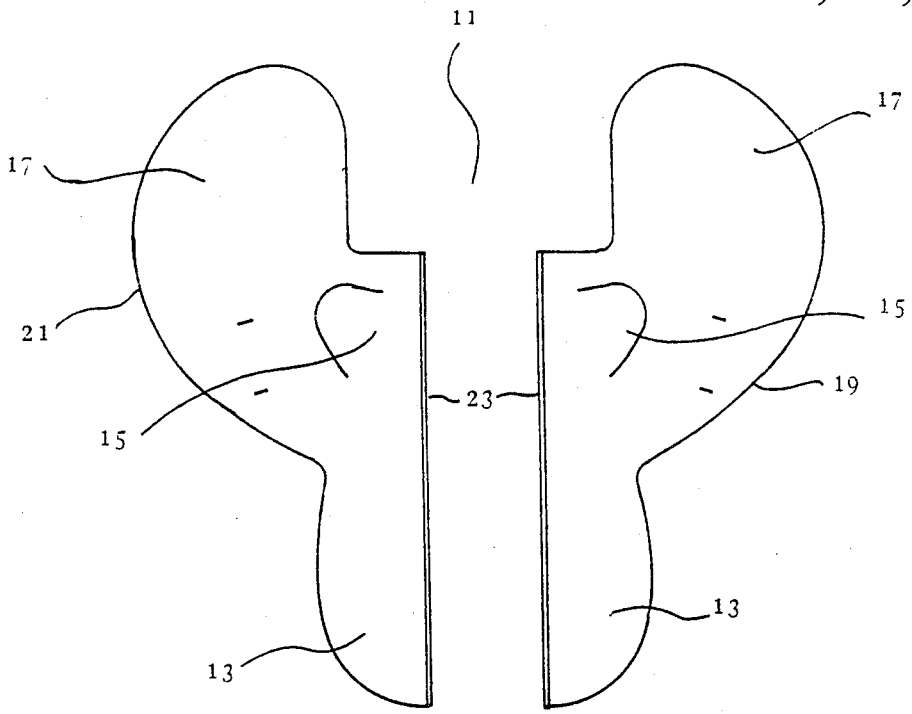
FIG. 1 is a plan view of the two separated halves of the upper saddle covering.
Figure 2:
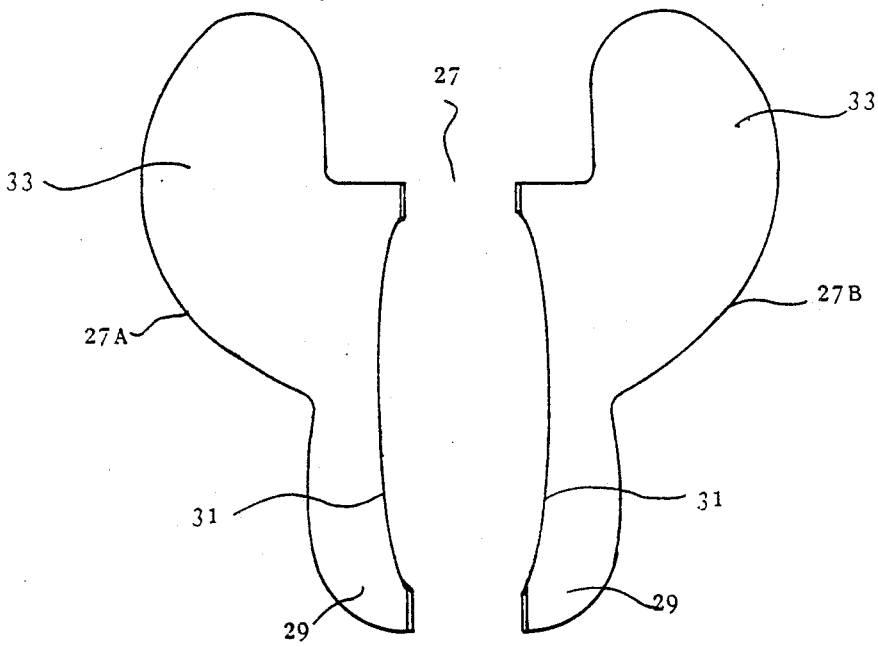
FIG. 2 is a plan view of the two separated halves of the underside saddle covering.
Figure 3:
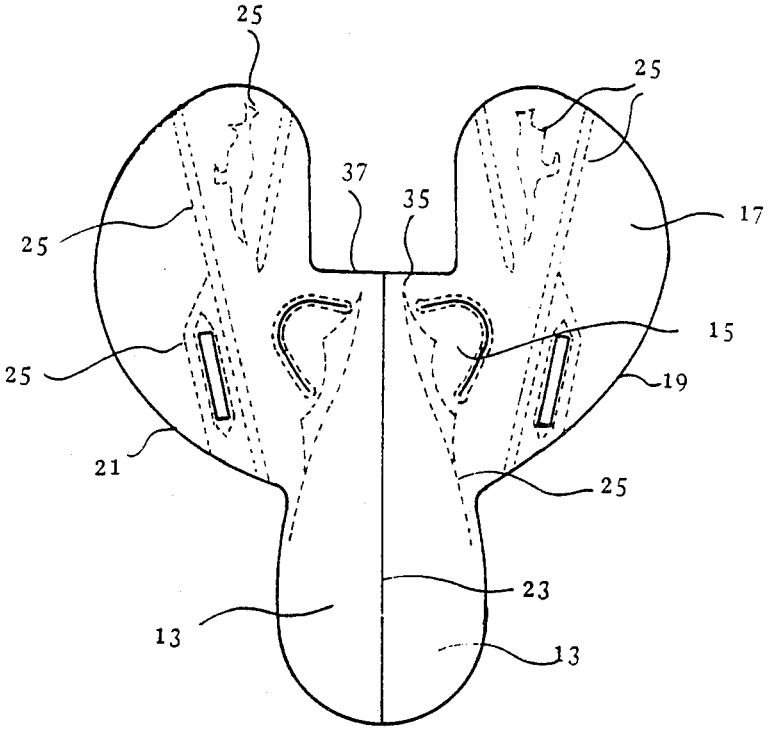
FIG. 3 is a plan view of complete upper covering.
Figure 4:
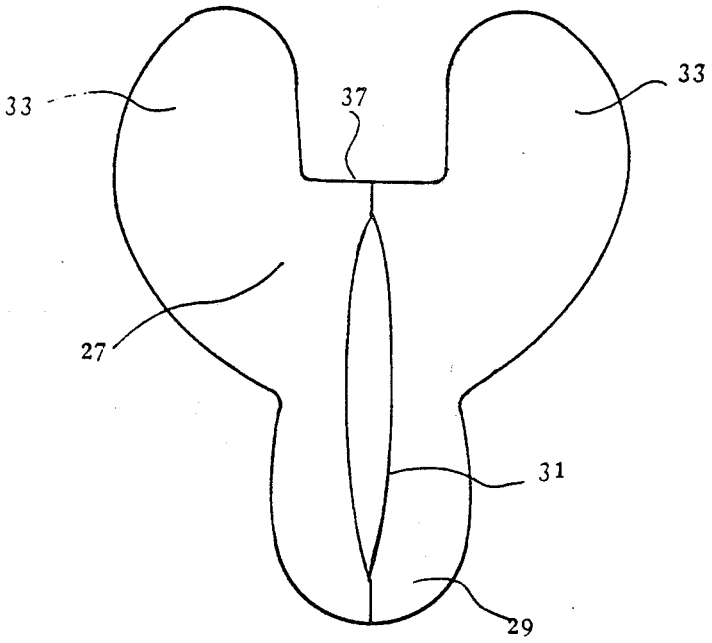
FIG. 4 is a plan view of complete underside covering.
Figure 5:
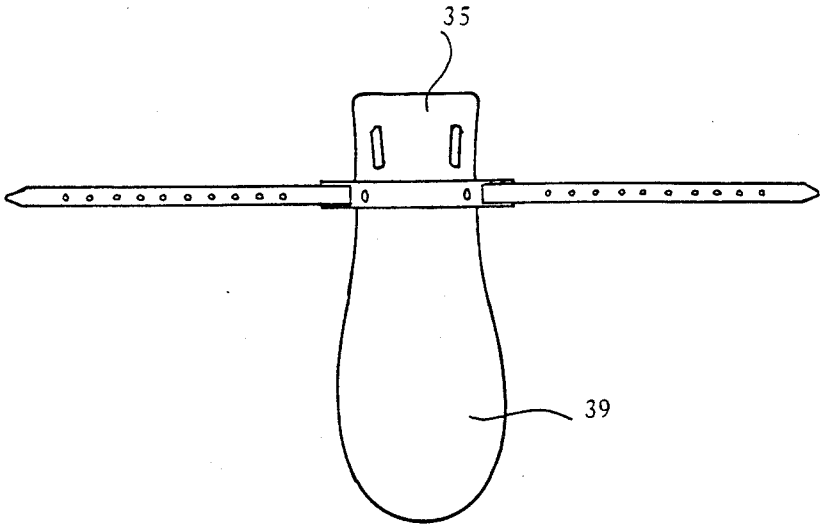
FIG. 5 is a plan view of a saddle tree.
Figure 6:
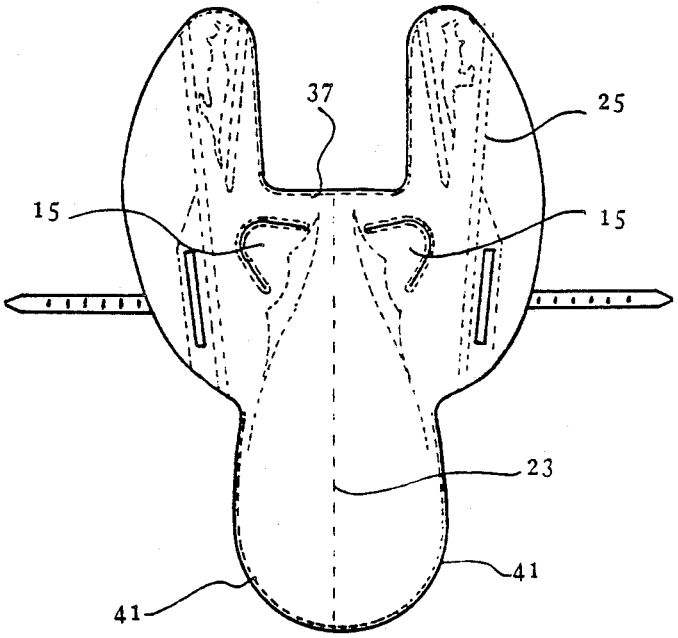
FIG. 6 is a plan view of the completed saddle.

In the embodiment shown in the drawings a light "racing saddle" can be constructed in a variety of colours by selecting the required coloured cloth covered high density foam sheet. The sheet foam preferably being cloth covered cross linked closed cell polyethylene from which is marketed under the trade mark of "Softlon". A saddle is constructed by firstly pressing or stamping from a single sheet member the upper saddle covering 11 comprising the seat 13, backs 15 and upper flaps 17. Preferably the right hand side 19 and the left hand side 21 are stamped out separately as shown in FIG. 1 of the drawings. The two separate halves are stitched together down the central lontitudinal seam 23 to form the complete upper saddle covering shown in FIG. 3. During the stitching of the two halves together strengthening or decorative stitching 25 can also be applied to the upper covering 11. Similarly, the underside saddle covering 27 is pressed in two separate halves 27A and 27B each including the panel 29, lining 31 and underflaps 33. The two separated halves being shown in FIG. 2 of the drawings and joined as one underside saddle covering in FIG. 4. The upper 11 and underside saddle covering 27 are then secured to a saddle tree 39, preferably by glueing, and the saddle construction completed by stitching the upper 11 and lower or underside saddle covering 27 together around the periphery 37 of the cantle 35 and the periphery 41 of the seat 13.

Alternatively the construction technique may be varied so that the upper 11 and underside saddle covering 27 are secured together around the periphery of the cantle 35 to form a pocket (not shown). The joining stitching 37 has been shown in FIGS. 3 and 4 of the drawings. A saddle tree 39 is inserted into the pocket formed between the upper and underside coverings and encased into position by securing, as at 41, the upper and underside coverings together around the periphery of the seat 13.

This method of construction enables a quantity of stamped or pressed components to be forwarded to a machinist together with the necessary number of saddle trees. The machinist with very little experience in saddlery is then very quickly and economically able to construct a saddle. The need for heavy industrial sewing machines is eliminated and so is the requirement for experienced machinists. The sheet material being utilised is extremely light, hard wearing and comfortable to both horse and rider.

In addition, the jockeys in the racing fraternity can have their own selected coloured riding saddles to match the coloured silks worn by them.

The claims defining the invention are as follows:

I claim:

1. A saddle comprising a saddle tree formed from a material forming substantially the sole structural element of said saddle, an upper saddle covering including a seat and upper flaps, and an underside saddle covering including a panel and under flaps, said saddle coverings being carried by the saddle tree, the improvement comprising under flaps and upper flaps each formed at least in substantial part from a composite sheet material consisting of a cloth-covered foam with the cloth facing outwardly and facing the body of the horse with respect to the under flaps and the legs of the rider in the case of the upper flaps, said cloth-covered foam being thin and pliable for effectively transfer control pressure from the rider's legs to the horse.

2. A saddle as claimed in claim 1, wherein the foam in the composite sheet material is a cross-linked closed cell polyethylene foam.

3. A saddle as claimed in claim 1, wherein all of the saddle coverings are formed from composite sheet material consisting of a cloth-covered foam.

4. A saddle as claimed in claim 3, wherein the foam in the composite sheet material is a cross-linked closed cell polyethylene foam.

5. A method of making a saddle comprising the steps of providing a saddle tree from a material sufficiently rigid to form the sole structural support for the saddle, providing composite sheet material consisting at least in substantial part of a cloth-covered foam to form an upper saddle covering unit including a seat and upper flaps, forming a lower saddle covering including a panel and under flaps, and securing the saddle coverings to the tree, the cloth-covered foam being assembled with the cloth facing outwardly and facing the body of the horse with respect to the under flaps and the legs of the rider in the case of the upper flaps, the cloth-covered foam being thin and pliable for effectively transfer control pressure from the rider's legs to the horse.

6. A method as claimed in claim 5, wherein the upper and lower saddle coverings are formed by cutting shaped sections and stitching the sections together.

7. A method as claimed in claim 6, wherein the upper and lower saddle coverings are secured to the tree by gluing.

8. A method of making a saddle comprising the steps of providing a saddle tree from a material sufficiently rigid to form the sole structural support for the saddle, providing composite sheet material consisting of a cloth--covered foam, cutting shaped sections from the sheet material and stitching the sections together to form at least in substantial part an upper saddle covering unit including a seat and upper flaps, cutting further shaped sections from the sheet material and stitching the further sections together to form at least in substantial part a lower saddle covering including a panel and underflaps, stitching the upper and underside saddle coverings partly together to define a pocket, inserting the tree into the pocket and closing the pocket by further stitching the upper and underside saddle coverings around the seat, the cloth-covered foam being assembled with the cloth facing outwardly and facing the body of the horse with respect to the under flaps and the legs of the rider in the case of the upper flaps, the cloth-covered foam being thin and pliable for effectively transfer control pressure from the rider's legs to the horse.

9. A method as claimed in claim 8, wherein the saddle coverings are secured to the tree by gluing.

* * * * *